US009675852B2

(12) United States Patent
Westrum

(10) Patent No.: US 9,675,852 B2
(45) Date of Patent: Jun. 13, 2017

(54) IRON-TYPE GOLF CLUB HEAD

(71) Applicant: Callaway Golf Company, Carlsbad, CA (US)

(72) Inventor: Joshua D. Westrum, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 15/255,665

(22) Filed: Sep. 2, 2016

(65) Prior Publication Data

US 2017/0028270 A1 Feb. 2, 2017

Related U.S. Application Data

(63) Continuation-in-part of application No. 14/812,971, filed on Jul. 29, 2015, now abandoned.

(60) Provisional application No. 62/242,252, filed on Oct. 15, 2015.

(51) Int. Cl.
*A63B 53/04* (2015.01)

(52) U.S. Cl.
CPC ..... *A63B 53/047* (2013.01); *A63B 2053/042* (2013.01); *A63B 2053/0408* (2013.01); *A63B 2053/0416* (2013.01); *A63B 2053/0425* (2013.01)

(58) Field of Classification Search
CPC ..... A63B 2053/042; A63B 60/54; A63B 2053/0416
USPC ..... 473/342, 345, 346, 350, 332, 33
See application file for complete search history.

(56) References Cited

U.S. PATENT DOCUMENTS

| | | | | |
|---|---|---|---|---|
| 6,746,342 | B1 * | 6/2004 | Hsieh | A63B 53/047 473/342 |
| 7,077,763 | B2 * | 7/2006 | Wahl | A63B 53/047 473/334 |
| 2012/0289360 | A1 * | 11/2012 | Breier | A63B 53/047 473/335 |
| 2016/0016052 | A1 * | 1/2016 | Dolezel | A63B 53/04 473/342 |

FOREIGN PATENT DOCUMENTS

JP 4958625 B2 * 6/2012

* cited by examiner

*Primary Examiner* — Aarti B Berdichevsky
*Assistant Examiner* — Rayshun Peng
(74) *Attorney, Agent, or Firm* — Rebecca Hanovice; Michael Catania; Sonia Lari

(57) ABSTRACT

A golf club head having a thin topline and improved sound is disclosed herein. The golf club head, which preferably is a three-piece iron-type head, comprises a body with truss supports linking a lower body portion of the iron with a top portion. This configuration creates an iron with the sound and feel of a closed cavity back iron and the performance and mass properties of an open cavity back iron. The golf club head also includes a partial face cup comprising a striking face and a lower flange and a dampening element filling at least a portion of a cavity between the body and the face cup. The dampening element comprises a portion that is compressed within the cavity and another portion that is adhered to the rear surface of the striking face.

13 Claims, 7 Drawing Sheets

IRON-TYPE GOLF CLUB HEAD

CROSS REFERENCES TO RELATED APPLICATIONS

The present application claims priority to U.S. Provisional Patent Application No. 62/242,252, filed on Oct. 15, 2015, and is a continuation-in-part of U.S. patent application Ser. No. 14/812,971, filed on Jul. 29, 2015, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to an iron-type golf club head with the sound and feel of a closed cavity back iron and the performance and mass properties of an open cavity back iron.

Description of the Related Art

Golfers often prefer to use irons with thin, mostly unsupported faces in order to increase ball speed off the face, improve forgiveness, and generally improve their performance on the golf course. Unfortunately, open backed irons with thin, unsupported faces typically do not have the sound and feel desired by golfers. This problem can be fixed by fully enclosing the back of such a cavity back iron, but a fully enclosed cavity construction raises the iron's center of gravity and thus negatively affects the iron's mass properties and performance. Therefore, there is a need for a high-performance iron with both a thin, unsupported face and an open cavity back.

BRIEF SUMMARY OF THE INVENTION

The present invention is directed to a golf club head with an optimized weight construction that: (1) allows for the use of a face cup without sacrificing an optimized center of gravity location; and (2) allows a golf club head manufacturer to take weight away from, and thus thin out, a sole of a golf club head, which permits the sole to flex and bend more easily and thus enhance the performance of the face cup. One aspect of the present invention is an iron-type golf club head with an open cavity back, a thin, forgiving face, and features tying the head's topline to its body without fully enclosing the cavity back.

Another aspect of the present invention is an iron-type golf club head comprising a body comprising a top portion, a sole portion, a heel side, a toe side, a front bonding area, a through-opening, a lower body portion, a first truss, and a second truss, a face component comprising a striking face and a lower flange extending away from the striking face, and a dampening element, wherein the body and the face component define an internal cavity, wherein the lower body portion comprises an internal weight lip, wherein the internal weight lip extends towards a rear surface of the striking face without touching any portion of the face component, wherein the through-opening is disposed between the top portion and the lower body portion, wherein each of the first truss and the second truss extends from the weight lip to the top portion via the through-opening, wherein neither of the first truss nor the second truss makes contact with any portion of the face component, and wherein the dampening element is disposed within the internal cavity and fills at least a rear portion of the through-opening.

In some embodiments, the iron-type golf club may further comprise a horizontal sole axis extending from a heel side of the sole portion to a toe side of the sole portion, and each of the first truss and the second truss may have a longitudinal axis that is approximately perpendicular to the sole axis when the iron-type golf club head is at address. In other embodiments, the internal weight lip may extend from the heel side to the toe side. In some embodiments, the thickness of the lower flange may increase as it extends away from the striking face. In still other embodiments, each of the first truss and the second truss may be approximately triangular in shape. In one embodiment, the iron-type golf club head may further comprise at least one adhesive pad, which may be disposed between the dampening element and the rear surface of the striking face.

In some embodiments, the dampening element may comprise a plurality of protrusions, which may envelop a portion of at least one of the first truss and the second truss. In a further embodiment, the plurality of protrusions may comprise a first protrusion, a second protrusion, and a third protrusion, and the first, second, and third protrusions may envelop a portion of each of the first truss and the second truss. In another embodiment, the plurality of protrusions may further comprise a fourth protrusion, which may be compressed between an inner surface of the lower body portion and the rear surface of the striking face. In yet another embodiment, each of the first, second, and third protrusions may be affixed to the rear surface of the striking face. In a further embodiment, the iron-type golf club head may further comprise first, second, and third adhesive pads, the first adhesive pad may affix the first protrusion to the rear surface of the striking face, the second adhesive pad may affix the second protrusion to the rear surface of the striking face, and the third adhesive pad may affix the third protrusion to the rear surface of the striking face.

Yet another aspect of the present invention is an iron-type golf club head comprising a body comprising a top portion, a sole portion, a heel side, a toe side, a through-opening, a lower body portion, a first truss, and a second truss, a face cup comprising a striking face having variable thickness, and a dampening element comprising a plurality of protrusions, wherein the body and the face cup define an internal cavity, wherein the lower body portion comprises an internal weight lip and an undercut area, wherein the through-opening is disposed between the top portion and the lower body portion, wherein each of the first truss and the second truss extends from the weight lip to the top portion via the through-opening, wherein each of the first truss and the second truss is approximately triangular in shape, wherein the dampening element is disposed within the internal cavity, and wherein the plurality of protrusions envelops a portion of at least one of the first truss and the second truss. In some embodiments, the dampening element may fill at least a rear portion of the through-opening and obscure the first and second trusses from view. In a further embodiment, a rear surface of the dampening element may be visible to a golfer and may comprise a logo feature.

In one embodiment, the iron-type golf club head may further comprise at least one adhesive pad, which may be disposed between the dampening element and a rear surface of the striking face. In another embodiment, at least a portion of the dampening element may be compressed between an inner surface of the lower body portion and a rear surface of the striking face. In still another embodiment, the iron-type golf club head may further comprise a seam between the face cup and the body, and the weight lip may extend over the seam and approach without contacting a rear surface of the striking face. In some embodiments, each of the body and the face cup may be composed of a titanium alloy, while in alternative embodiments, the body may be composed of a first metal material and the face cup may be composed of a second, different metal material.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
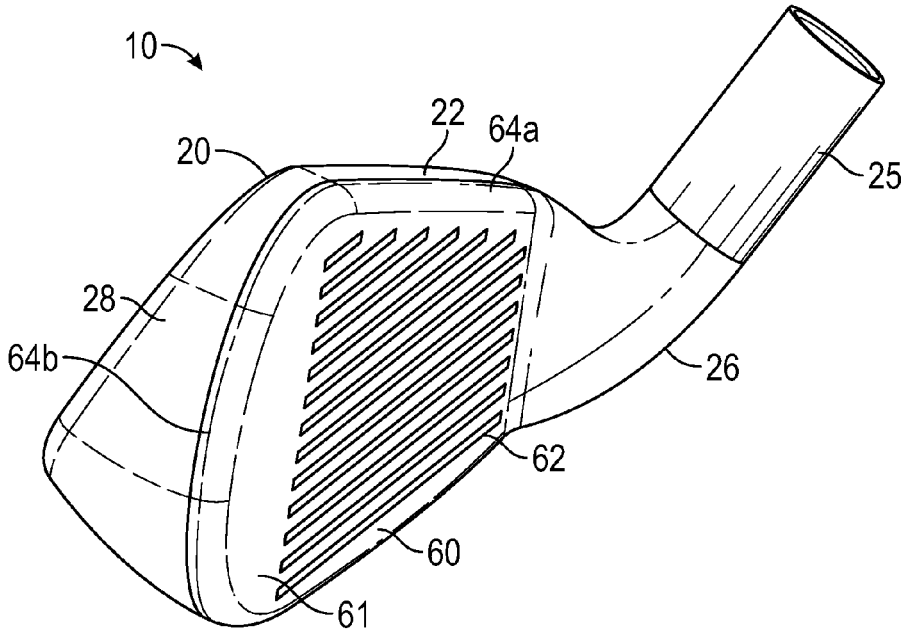
FIG. 1 is a top elevational view of a preferred embodiment of the golf club head of the present invention.

The present invention is generally directed to an open cavity back iron-type golf club head with a truss system, which, by connecting the topline of the club head to the body, creates the sound and feel of a closed cavity back iron while at the same time providing the desirable performance and mass properties of an open cavity back iron. The golf club head of the present invention also includes internal weighting that places the golf club center of gravity at a point near the face and the sole of the golf club head.

In the preferred embodiment, shown in FIGS. 1-14, the iron-type golf club head 10 has a three-piece construction, with a body 20, a face cup 60, and a dampening element 100. The body 20 includes a top portion 22, a sole portion 24, a heel side 26, a hosel 25, a toe side 28, a lower body portion 30, a through-opening 29 that extends through the entire width of the body 20, a front bonding area 23 that receives a portion of the face cup 60, and a pair of trusses 40, 45 that extend from the lower body portion 30 to the top portion 22 and divide up the through-opening 29. The lower body portion 30 preferably includes a weight lip 32 and an undercut area 34, both of which are fully enclosed when the body 20 is affixed to the face cup 60. The weight lip 32 lowers the golf club head's 10 center of gravity, while the undercut area 34 allows the golf club head 10 to have a thin sole 24 and allows for greater face cup 60 flexibility.

Figure 13:
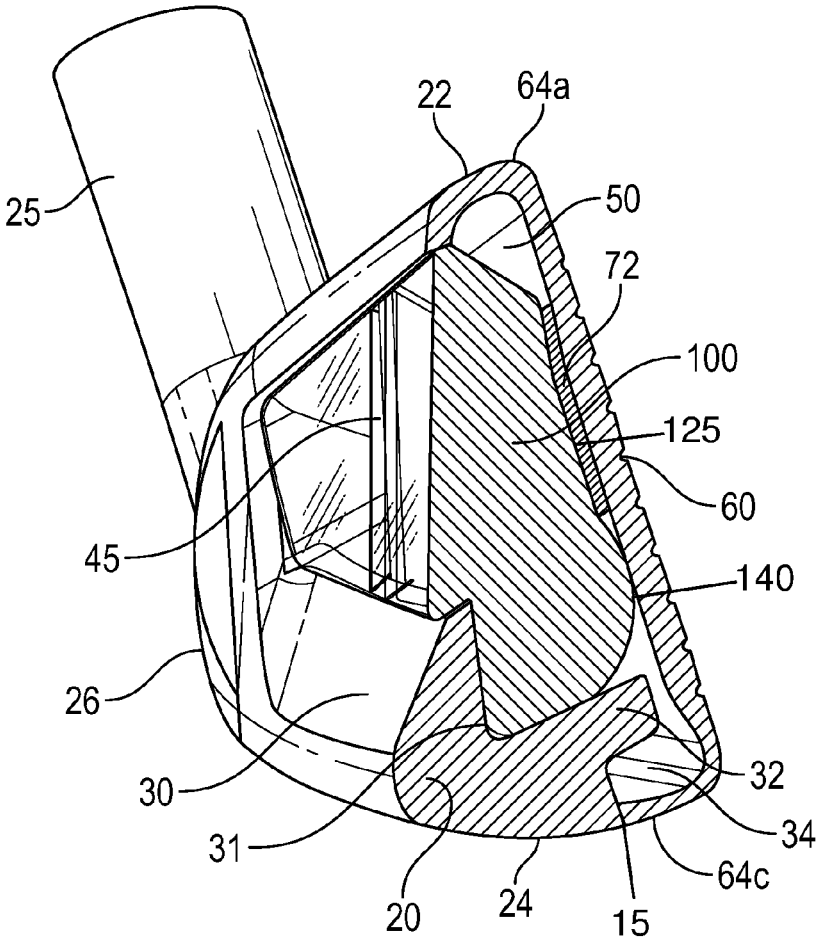
FIG. 13 is a cross-sectional view of the golf club head shown in FIG. 12 along lines 13-13.
Figure 14:
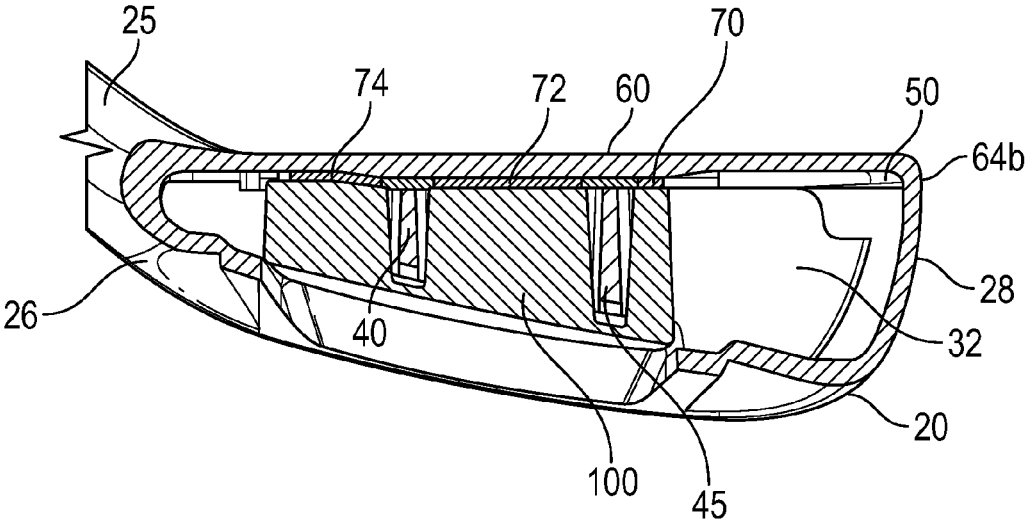
FIG. 14 is a cross-sectional view of the golf club head shown in FIG. 12 along lines 14-14.

The weight lip 32 extends from the sole portion 24 and lower body portion 30 towards the front bonding area 23, and also extends from the heel side 26 towards the toe side 28 of the body 20. As shown in FIG. 13, at least a portion of the weight lip 32 protrudes away from the body 20, such that when the body 20 is assembled with the face cup 60, the weight lip 32 extends over the seam 15 between the body 20 and the face cup 60 and approaches, but does not make contact with, the rear surface 63 of the striking face 61. In fact, no portion of the weight lip 32 makes contact with any part of the face cup 60. In some embodiments, the weight lip 32 may contact both the heel and toe sides 26, 28 of the body 20, and may have any of the features disclosed in U.S. Pat. Nos. 9,211,451, 8,926,448, and 8,900,070, the disclosure of each of which is hereby incorporated by reference in its entirety herein, or any of the features disclosed in U.S. patent application Ser. No. 14/797,512, the disclosure of which is hereby incorporated by reference in its entirety herein. The inertia of the weight lip 32 during impact of the golf club head 10 with a ball improves sole 24 compliance by enhancing the bending capabilities of thinner regions of the sole 24.

The trusses 40, 45 preferably are parallel with one another and approximately perpendicular to a ground plane 90 when the club head is placed at address. Each truss 40, 45 has a top end 41, 46 that intersects the top portion 22 and a bottom end 42, 47 that connects with the weight lip 32 in the lower body portion 30. Each truss 40, 45 is approximately triangular in shape, with the wider bottom end 42, 47 connecting with the weight lip 32 and the narrow top end 41, 46 connecting with the top portion 22. This configuration helps to move mass downwards and away from the top portion 22. When the golf club head 10 is fully assembled, no portion of the either truss 40, 45 makes contact with any part of the face cup 60, though the bottom end 42, 47 of each truss 40, 45 approaches the rear surface 63 of the face.

Figure 2:
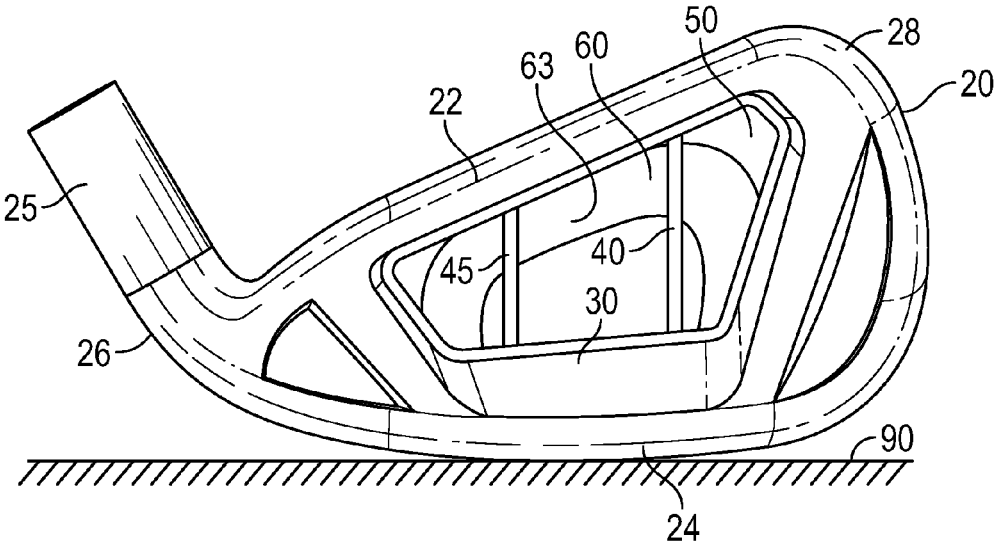
FIG. 2 is a rear elevational view of the golf club head shown in FIG. 1 without the dampening element.
Figure 3:
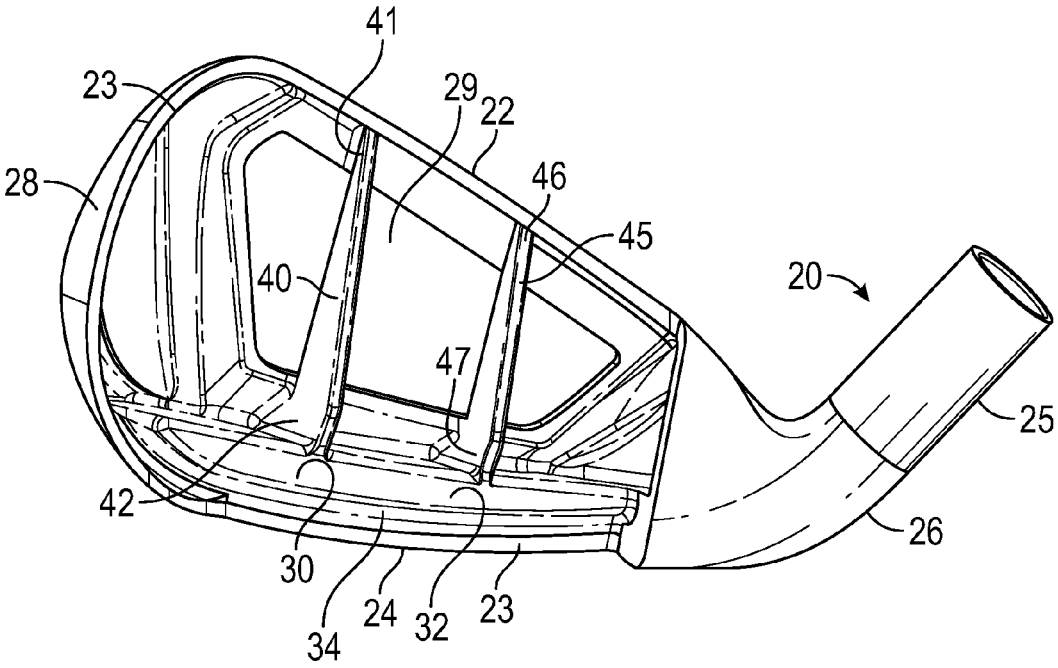
FIG. 3 is a front elevational view of the golf club head shown in FIG. 1 without the face cup or the dampening element.
Figure 4:
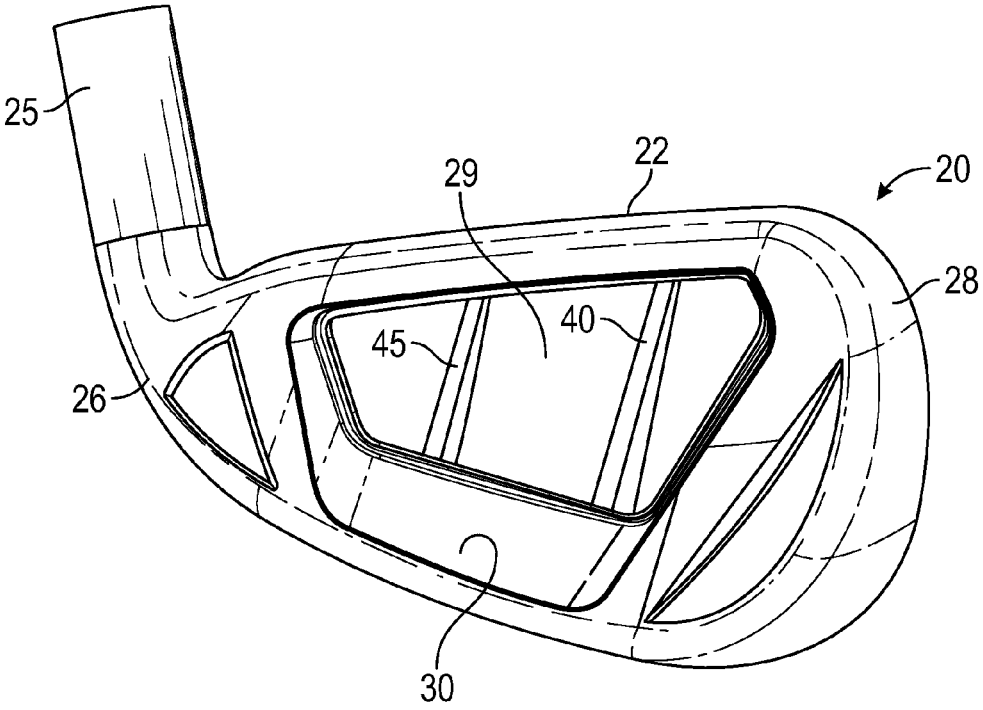
FIG. 4 is a rear perspective view of the golf club head shown in FIG. 3.
Figure 5:
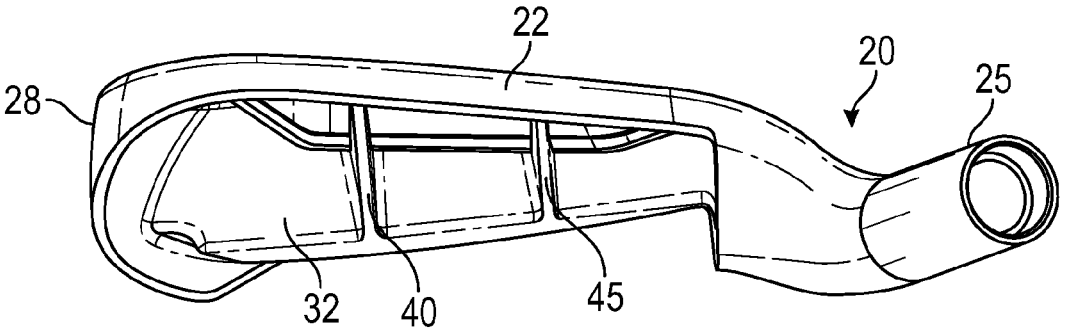
FIG. 5 is a top perspective view of the golf club head shown in FIG. 3.
Figure 6:
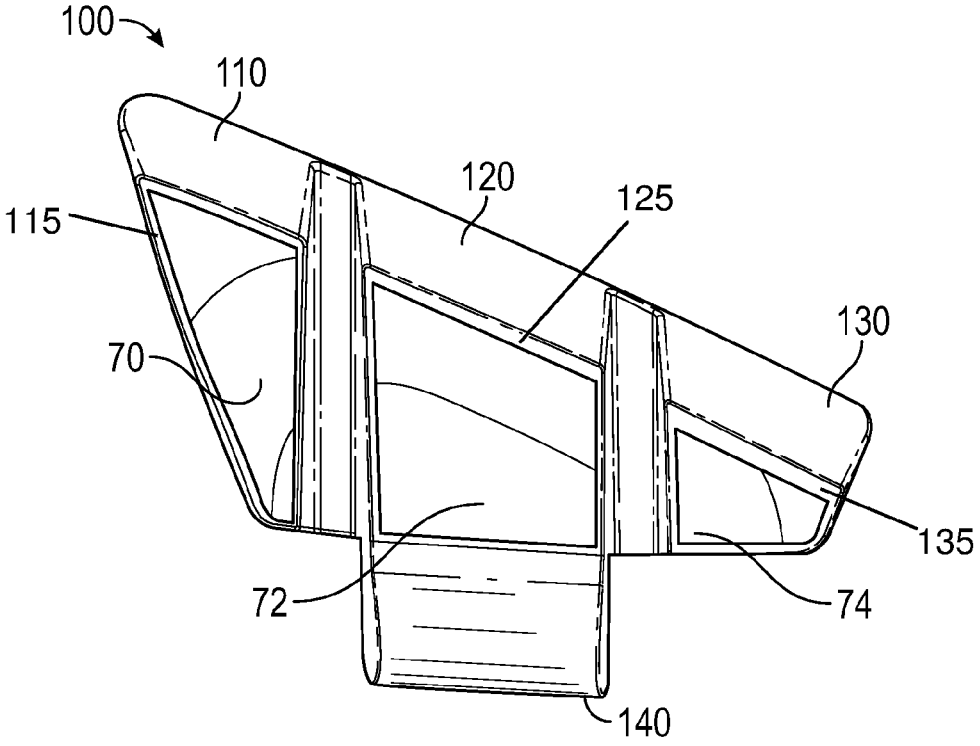
FIG. 6 is a front plan view of the dampening element feature of the golf club head shown in FIG. 1.
Figure 7:
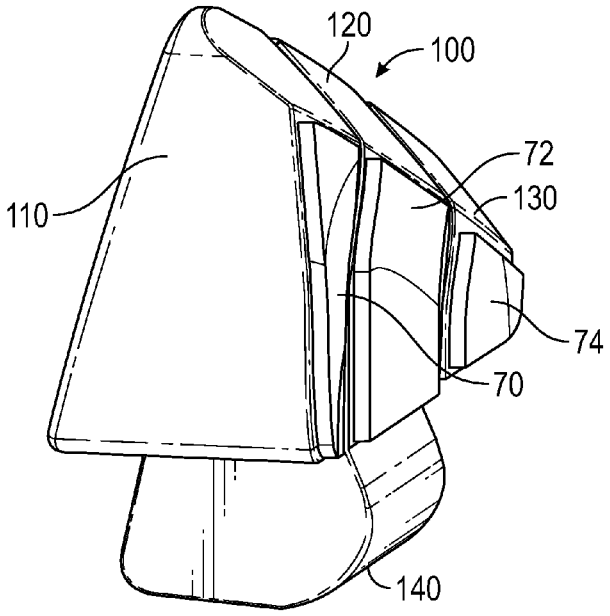
FIG. 7 is a side perspective view of the dampening element shown in FIG. 6.
Figure 8:
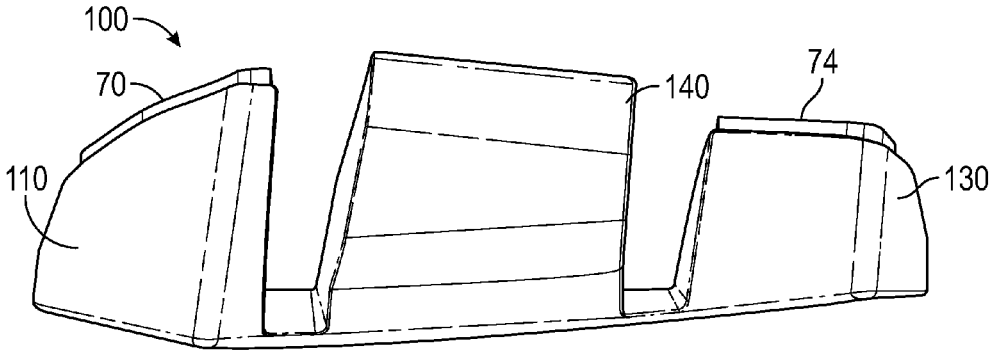
FIG. 8 is a bottom elevational view of the dampening element shown in FIG. 6.
Figure 9:
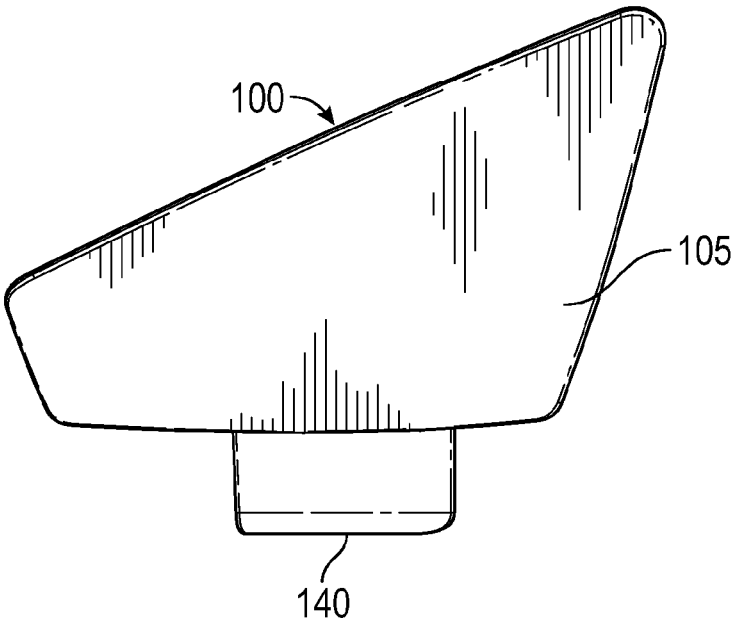
FIG. 9 is a rear plan view of the dampening element shown in FIG. 6.
Figure 10:
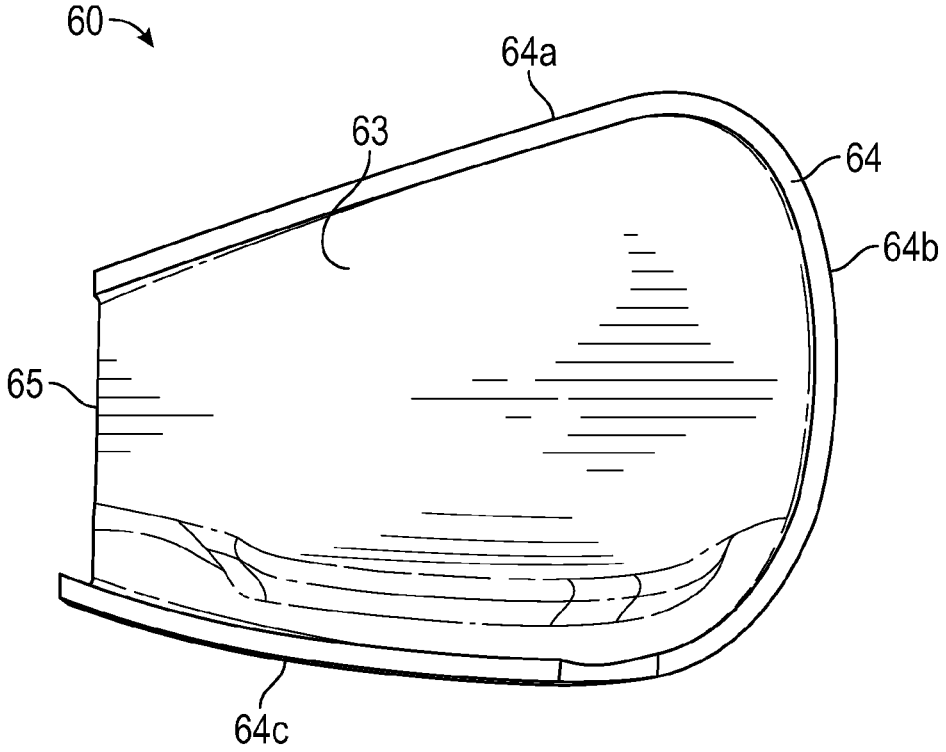
FIG. 10 is a rear elevational view of the face cup shown in FIG. 1.
Figure 11:
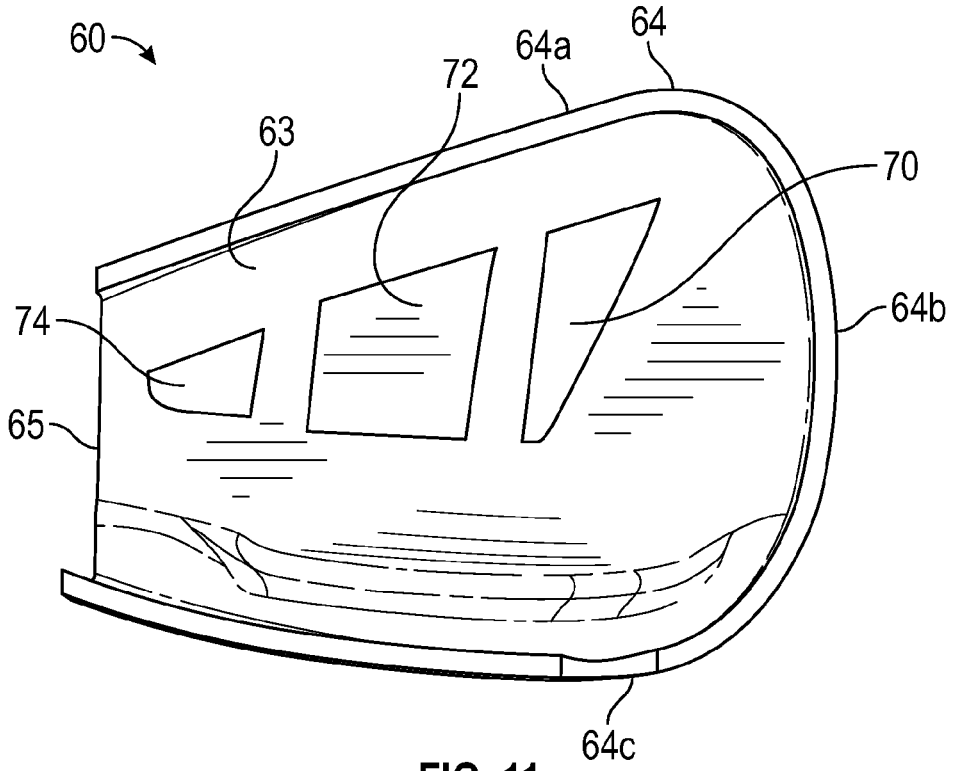
FIG. 11 is a rear elevational view of the face cup shown in FIG. 10 with adhesive pads attached thereto.

As shown in FIGS. 1, 10, 11, and 13, the face cup 60 comprises a striking face 61 with a plurality of scorelines 62 and a rear surface 63, a rear-extending portion 64 at the top, toe, and sole sides 64*a*, 64*b*, 64*c* of the striking face 61, and a heel side edge 65 that abuts the heel side 26 of the body 20. FIGS. 2, 10, and 11 show that the rear surface 63 of the striking face 61 preferably has variable thickness, in this embodiment an elliptical thickness pattern with a greatest thickness proximate the center of the striking face 61, for greater forgiveness. The thickness of the sole side 64*c* of the rear-extending portion 64 preferably increases as it extends away from the striking face 61, which improves the performance of the golf club head 10 and the ease with which the face cup 60 is welded to the body 20. At least a part of the sole side 64*c* of the rear-extending portion 64 is greater in front-to-back length than the top side 64*a*, forming a flange that extends underneath the weight lip 32 when the face cup 60 is assembled with the body 20.

Figure 12:
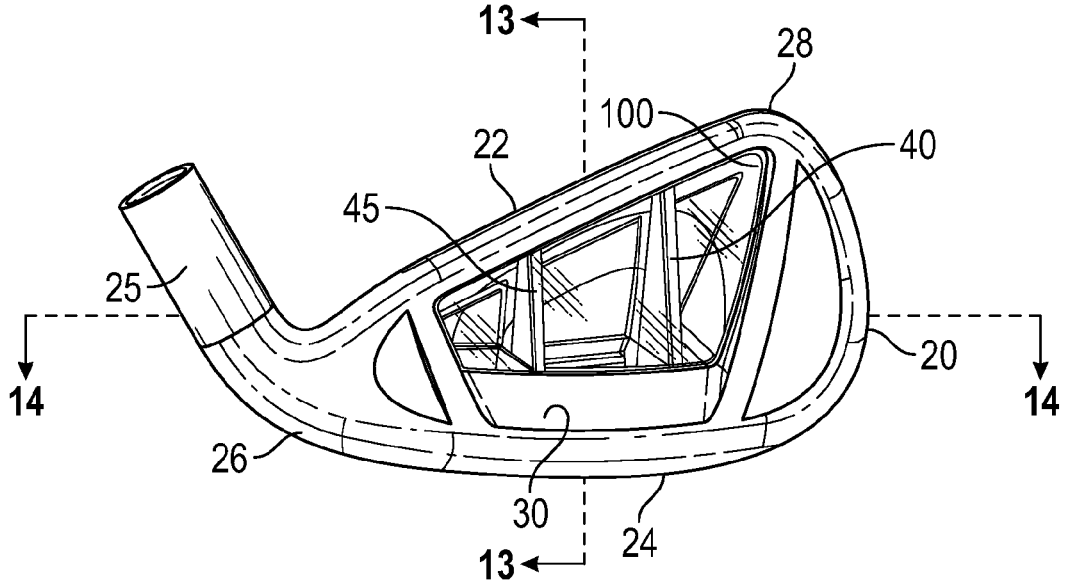
FIG. 12 is a rear elevational, partially transparent view of the golf club head shown in FIG. 1.

When the body 20 is assembled with the face cup 60, the golf club head 10 has an internal cavity space 50 that is at least partially filled by the dampening element 100. At the very least, the dampening element 100 fills the through-opening 29 area of the body, as illustrated in FIG. 12, thus obscuring the trusses 40, 45 from view and preventing any debris from entering the internal cavity space 50. The dampening element 100 of the preferred embodiment is shown in greater detail in FIGS. 6-9, and comprises four protrusions 110, 120, 130, 140. The first three protrusions 110, 120, 130 are arranged to envelop the regions of trusses 40, 45 that are proximate the through-opening 29, and the fourth protrusion 140 is designed to extend downwards between the trusses 40, 45 and make contact with the weight lip 32. The back side 105 of the dampening element 100 is visible to a golfer via the through-opening 29 when the golf club head 10 is fully assembled, and may include one or more colors, logos, textures, and/or other features as desired by the golf club head manufacturer or golfer.

When the dampening element 100 is assembled with the body 20 and the face cup 60, the front surfaces 115, 125, 135 of each of the first three protrusions 110, 120, 130 make contact with the rear surface 63 of the striking face 61. In order to ensure that these three protrusions 110, 120, 130 make continuous contact with the rear surface 63, three adhesive pads 70, 72, 74 are disposed between at least a portion of each of the front surfaces 115, 125, 135 of each of the first three protrusions 110, 120, 130 and the rear surface 63 of the striking face 61. The fourth protrusion 140 of the dampening element 100 is compressed between an inner surface 31 of the lower body portion 30 and the rear surface 63 of the striking face 61, as shown in FIG. 13.

For each of the embodiments disclosed herein, the body 20 and the face cup 60 may be formed from any suitable material, including but not limited to stainless steel, carbon steel, and titanium alloy. While the trusses 40, 45 preferably are integrally formed with the rest of the body 20 via forging or casting, they may in alternative embodiments be separately formed from the same or a different material and then welded, brazed, soldered, or otherwise affixed to the body 20 in the configurations described herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. An iron-type golf club head comprising:

a body comprising a top portion, a sole portion, a heel side, a toe side, a front bonding area, a through-opening, a lower body portion, a first truss, and a second truss;

a face component comprising a striking face and a lower flange extending away from the striking face;

first, second, and third adhesive pads; and a dampening element comprising a plurality of protrusions, wherein the plurality of protrusions comprises a first protrusion, a second protrusion, and a third protrusion, wherein the first, second, and third protrusions envelop a portion of each of the first truss and the second truss, wherein the first adhesive pad affixes the first protrusion to a rear surface of the striking face, wherein the second adhesive pad affixes the second protrusion to the rear surface of the striking face, wherein the third adhesive pad affixes the third protrusion to the rear surface of the striking face, wherein the body and the face component define an internal cavity, wherein the lower body portion comprises an internal weight lip, wherein the internal weight lip extends towards a rear surface of the striking face without touching any portion of the face component, wherein the through-opening is disposed between the top portion and the lower body portion, wherein each of the first truss and the second truss extends from the weight lip to the top portion via the through-opening, wherein neither of the first truss nor the second truss makes contact with any portion of the face component, and wherein the dampening element is disposed within the internal cavity and fills at least a rear portion of the through-opening.

2. The iron-type golf club head of claim 1, further comprising a horizontal sole axis extending from a heel side of the sole portion to a toe side of the sole portion, wherein each of the first truss and the second truss has a longitudinal axis that is approximately perpendicular to the sole axis when the iron-type golf club head is at address.

3. The iron-type golf club head of claim 1, wherein the internal weight lip extends from the heel side to the toe side.

4. The iron-type golf club head of claim 1, wherein the thickness of the lower flange increases as it extends away from the striking face.

5. The iron-type golf club head of claim 1, wherein each of the first truss and the second truss is approximately triangular in shape.

6. The iron-type golf club head of claim 1, wherein the plurality of protrusions further comprises a fourth protrusion, and wherein the fourth protrusion is compressed between an inner surface of the lower body portion and the rear surface of the striking face.

7. An iron-type golf club head comprising:

a body comprising a top portion, a sole portion, a heel side, a toe side, a through-opening, a lower body portion, a first truss, and a second truss;

a face cup comprising a striking face having variable thickness;

a seam disposed between the face cup and the body; and a dampening element comprising a plurality of protrusions, wherein the body and the face cup define an internal cavity, wherein the lower body portion comprises an internal weight lip and an undercut area, wherein the weight lip extends over the seam and approaches, but does not make contact with, a rear surface of the striking face, wherein the through-opening is disposed between the top portion and the lower body portion, wherein each of the first truss and the second truss extends from the weight lip to the top portion via the through-opening, wherein each of the first truss and the second truss is approximately triangular in shape, wherein the dampening element is disposed within the internal cavity, and wherein the plurality of protrusions envelops a portion of at least one of the first truss and the second truss.

8. The iron-type golf club head of claim 7, wherein the dampening element fills at least a rear portion of the through-opening and obscures the first and second trusses from view.

9. The iron-type golf club head of claim 8, wherein a rear surface of the dampening element is visible to a golfer and comprises a logo feature.

10. The iron-type golf club head of claim 7, further comprising at least one adhesive pad, wherein the at least one adhesive pad is disposed between the dampening element and a rear surface of the striking face.

11. The iron-type golf club head of claim 7, wherein at least a portion of the dampening element is compressed between an inner surface of the lower body portion and a rear surface of the striking face.

12. The iron-type golf club head of claim 7, wherein each of the body and the face cup is composed of a titanium alloy.

13. The iron-type golf club head of claim 7, wherein the body is composed of a first metal material, wherein the face cup is composed of a second metal material, and wherein the first metal material is different from the second metal material.

* * * * *